United States Patent [19]

Verrall

[11] Patent Number: 4,951,369

[45] Date of Patent: Aug. 28, 1990

[54] WIRE PROCESSING APPARATUS

[75] Inventor: Robert B. Verrall, Barnstaple, Great Britain

[73] Assignee: AMP Incorporated, Harrisburg, Pa.

[21] Appl. No.: 350,421

[22] Filed: May 11, 1989

[30] Foreign Application Priority Data

Jul. 8, 1988 [GB] United Kingdom ..... 8816325.8

[51] Int. Cl.[5] ..... H01R 43/00

[52] U.S. Cl. ..... 29/33 M; 29/564.4; 29/748; 29/753; 83/580; 83/947; 140/105

[58] Field of Search ..... 29/33 M, 564, 564.4, 29/747, 748, 753; 81/9.51; 83/580, 947; 140/105

[56] References Cited

U.S. PATENT DOCUMENTS

| | | | |
|---|---|---|---|
| 3,403,441 | 10/1968 | Eubanks | 81/9.51 |
| 3,550,239 | 12/1970 | Rider . | |
| 3,553,814 | 1/1971 | Rider . | |
| 3,630,105 | 12/1971 | Rider . | |
| 3,766,625 | 10/1973 | Wagner . | |
| 3,833,993 | 9/1974 | Kremkav . | |
| 3,919,758 | 11/1975 | Stephan | 29/753 |
| 4,031,613 | 6/1977 | Brown et al. . | |
| 4,040,180 | 8/1977 | Brown . | |
| 4,194,281 | 3/1980 | Sudmestad | 29/564.4 |
| 4,581,796 | 4/1986 | Fukuda et al. | 29/748 |
| 4,601,093 | 7/1986 | Cope | 29/564.4 |
| 4,631,823 | 12/1986 | Collier et al. | 29/564.4 |

*Primary Examiner*—Daniel W. Howell
*Attorney, Agent, or Firm*—Bruce J. Wolstoncroft

[57] ABSTRACT

Apparatus for stripping the insulation from an end portion of an insulated electrical wire (W), withdrawing an electrical terminal (ET) from a carrier tape (T) therefor and crimping the terminal (ET) to the stripped end portion of the wire (W), comprises a rotary conveyor (18) for advancing the tape (T) step by step to align it with a fixed wire gripper (10), a prefeed mechanism (20) for partially detaching the terminal (ET) from the tape (T), an insulation severing and stripping unit (12), and a pair of terminal gripping and terminal crimping heads (14 and 16). The insulation severing and wire stripping unit (12) is retracted to strip an end portion of the insulated wire (W) upon the end of the wire (W) interrupting a laser beam (L). The gripping and crimping heads (14 and 16) are then closed about the terminal (ET) to grip it and are then advanced towards the wire gripper (10) to insert the stripped end portion (MC) of the wire (W) into the terminal (ET) after which the gripping and crimping heads (14 and 16) are pressed together to cause indenters (32) to crimp the terminal (ET) to the stripped end portion (MC). The gripping and crimping heads (14 and 16) are then retracted, and the wire gripper (10) opens its wire gripping jaws (22) to allow the crimped terminal (ET) to be withdrawn from the apparatus by pulling on the wire (W). The terminal (ET) is fully detached from the tape (T) when the gripping and crimping heads (14 and 16) are advanced towards the wire gripper (10) so that when the terminal (ET) is pulled from the apparatus, no sensible tension need be applied to the wire (W).

18 Claims, 13 Drawing Sheets

FIG. 2A
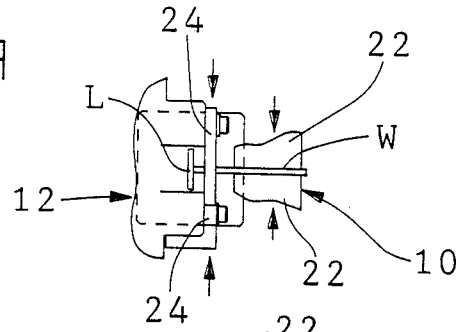
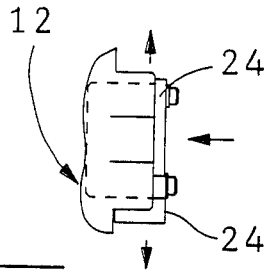
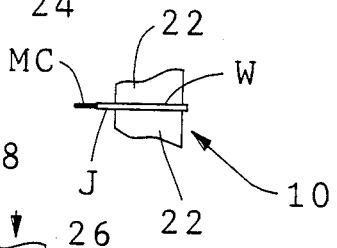
FIG. 2B
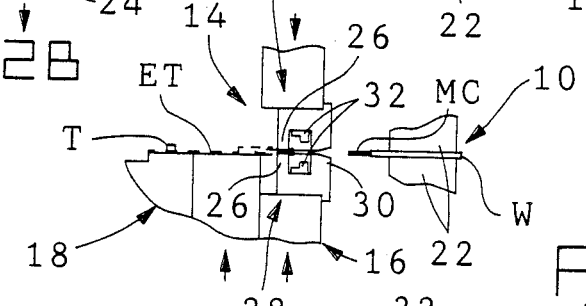
FIG. 2C
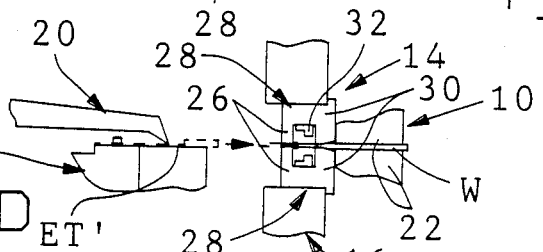
FIG. 2D
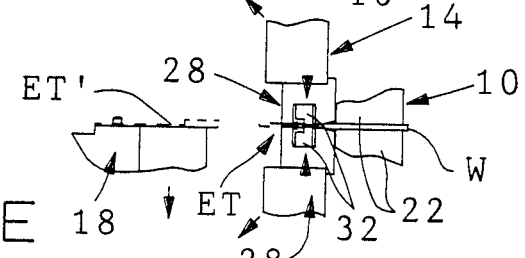
FIG. 2E
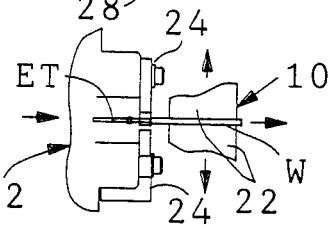
FIG. 2F 202
206
204
14
190
198
196
196
188
192
218
32
28
106
T
ET
26
30
26
30
32
18
28
16

WIRE PROCESSING APPARATUS

This invention relates to wire processing apparatus, and in particular apparatus for stripping the insulation from an end portion of an insulated electrical wire, withdrawing an electrical terminal from a carrier tape therefor, and crimping the terminal to the stripped end portion of the wire, and also relates to a wire gripper unit in combination with a wire processing unit.

In apparatus currently used, for stripping the end portions of electrical wires, and crimping tape carried electrical terminals to stripped end portions of the wires, it is necessary for the operator to detach each crimped terminal from the tape by pulling on the wire subsequently to the crimping operation thereby applying tension to the wire and thus to the crimped connection between the wire and the terminal. Since any action that would tend to weaken the connection, is undesirable, especially where the connection must be of high integrity, for example, in the manufacture of electrical leads for sensitive circuits in aircraft, it is an object of the present invention to avoid the disadvantage outlined above.

According to one aspect of the present invention, apparatus for stripping the insulation from an end portion of an insulated electrical wire, withdrawing an electrical terminal from a carrier tape therefor, and crimping the terminal to the stripped end portion of the wire, comprises a wire gripper first unit, an insulation severing and stripping second unit, a terminal prefeed third unit, a pair of terminal gripping and terminal crimping heads and a carrier tape conveyor, the second unit being moveable back and forth along a path of movement, between an advanced position proximate to the first unit, to receive and sever the insulation of, the end portion of an insulated wire gripped by the first unit, and a retracted position remote from the first unit to strip the insulation from said end portion, said heads being moveable between an open position in which they are clear of said path and a closed, terminal gripping position intersecting said path, the third unit being actuable partially to withdraw said terminal from said tape for positioning by said tape conveyor between said heads in the open position thereof and in the retracted position of the first unit, so that said heads grip the terminal when moved to their closed position, said heads being moveable in that position towards the first unit fully to withdraw the terminal from the tape and to insert the stripped wire end portion into the terminal and being then actuable to crimp the terminal to the stripped wire end portion.

Thus upon the terminal gripping and terminal crimping heads being returned to their open position, and the gripper unit being actuated to release the wire, no sensible tension need be applied by the operator to the wire in order to remove the wire and the terminal from the apparatus.

As the stripped wire end is inserted into the terminal, by the apparatus, in the axial direction of the wire, the terminal may have a wire receiving crimping ferrule of the closed barrel type, that is to say, a ferrule which is tubular rather than being of U-shaped cross section.

In order to take account of a further requirement, that the stripped length of the wire should be accurately determined, so that on the one hand, no uninsulated portion of the wire core projects from the terminal, and so that on the other hand, the length of the stripped end portion that is inserted into the terminal is not so short as to impair electrical connection between the wire and the terminal, the depth to which the end of the wire can be inserted between insulation severing jaws of the insulation severing and stripping unit is controlled by means of a laser beam extending on the side of the jaws remote from the gripper unit which is actuable, immediately the wire end has interrupted the laser beam, to ensure that the wire can be no further moved in the direction of said stripping unit, the jaws of which are then actuable to sever the insulation of the wire.

When the operator inserts the wire between wire gripping jaws of the wire gripper unit, to position the wire end between the jaws of the wire severing and wire stripping unit, there should be minimal clearance between the jaws of the wire gripper unit and the wire, not only to ensure that the end of the wire is correctly inserted between the wire stripping jaws but also to avoid too rapid insertion of the wire by the operator, to an extent to cause the stripped length of the wire to exceed that determined by the position of the laser beam relative to the wire stripping jaws, that is to say to avoid the end of the wire passing sensibly beyond the laser beam. To this end, means are provided for adjusting said clearance in accordance with the gauge of the wire.

According to another aspect of the invention, a wire end processing apparatus which comprises a wire gripper unit having wire gripper jaws and means for moving the jaws between a fully open position, a fully closed position and a partially open wire receiving position in which the wire, an end portion of which is to be processed, can be inserted between the jaws; and a wire processing unit aligned with the wire gripper unit for receiving and processing said end portion of the wire when it has been inserted between said jaws, is provided with means for emitting and sensing a laser beam extending through the wire processing unit and for causing said jaws fully to close when the end of the wire interrupts the laser beam, and is also provided with means for adjusting the extent to which the jaws can close to said wire receiving position, to ensure that there is minimal clearance between the jaws and the wire, in dependence upon the gauge of the wire.

Where, as for some uses in the Aircraft Industry, the wire is intended to withstand very high temperatures, the wire will comprise a relatively soft outer jacket and a hard, resinous, varnish-like inner insulation covering the metal core of the wire. Such varnish-like insulation is most difficult to sever, and strip from the wire end portion completely, as it tends to crumble.

According to another aspect of the invention, therefore, the insulation severing blades, each comprise a pair of mild steel blade supports between which is sandwiched, an insulation severing blade made of a hardened steel, for example the kind of steel of which razor blades are made, each blade support having a wire receiving notch arranged in alignment with a wire receiving notch of the other blade support and with a wire receiving notch of the hardened steel blade, which notch is of smaller radius than the wire receiving notches of the blade supports.

It has been found that such blades not only cut cleanly through the jacket of the wire but also cut cleanly through the varnish-like insulation and strip it cleanly from the metal core of the wire.

For a better understanding of the invention and to show how it may be carried into effect, an embodiment thereof will now be described by way of example with reference to the accompanying drawings in which;

FIGS. 2A to 2F are diagrams illustrating successive stages in a cycle of operation of apparatus for stripping end portions of insulated electrical wires, removing the terminals from the tape upon which they are mounted, and for crimping the terminals to the stripped wire end portions;

Figure 1:
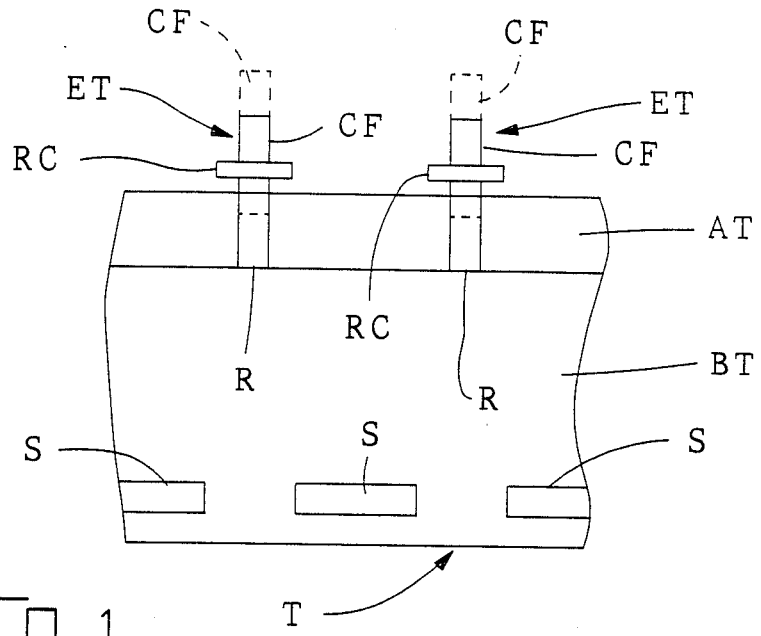
FIG. 1 is a fragmentary plan view of a strip of tape mounted electrical terminals.
Figure 8:
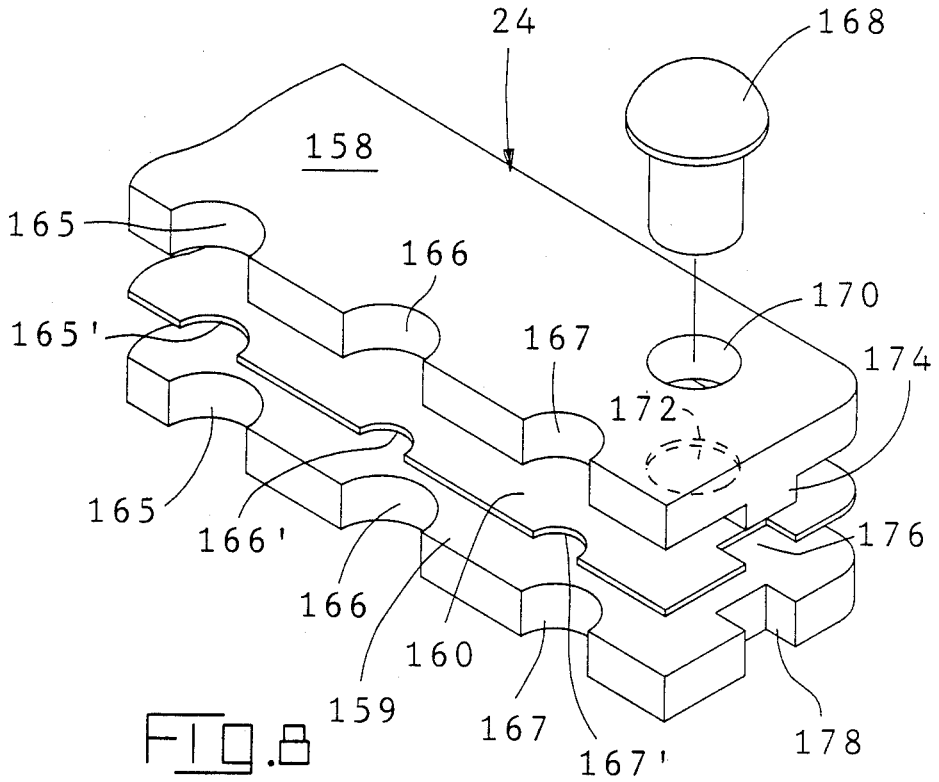
FIG. 8 is a fragmentary, diagrammatic, exploded, isometric view of a wire stripper jaw of the wire stripper unit.

FIG. 1 shows a fragment of an indefinite length of electrical terminal carrier tape, generally referenced T, and comprising a base tape BT having a row of tape indexing slots S extending along one margin thereof, and adhered to the tape T by means of an adhesive tape AT, adjacent to the opposite margin thereof, a row of electrical terminals ET having receptacle portions R extending between the tape BT and AT and circular cross section, tubular crimping ferrule portions CF projecting beyond said opposite margin. Intermediate its portion CF and R, each terminal ET has a circular radial collar RC positioned just beyond said opposite margin. Each terminal ET can be axially advanced against the action of the adhesive on the tape AT from the position in which the terminal is shown in full lines in FIG. 1, to that in which it is shown in broken lines therein, whilst still remaining adhered to the carrier tape T.

Figure 13:
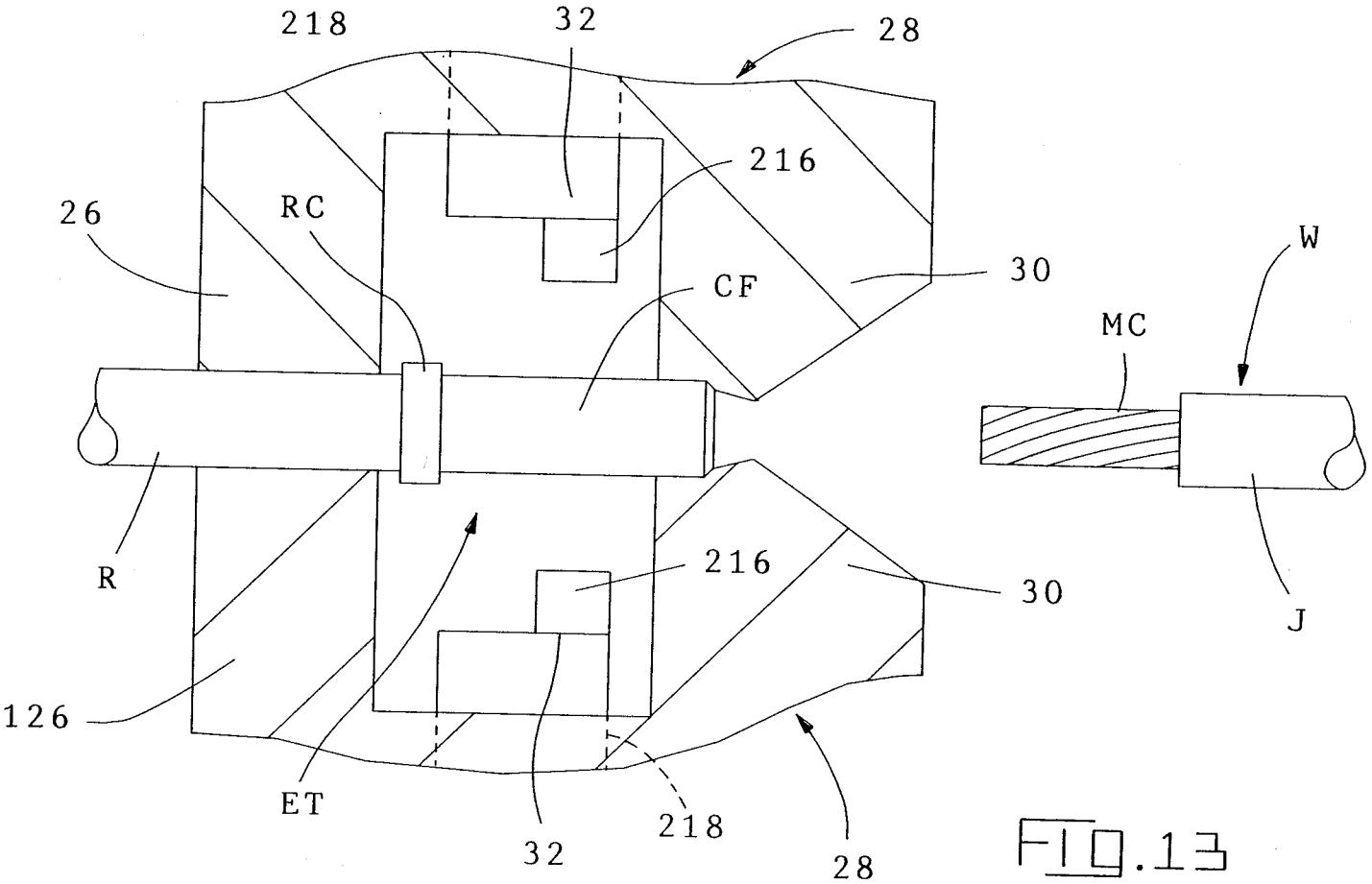
FIG. 13 is a diagrammatic, fragmentary, enlarged sectional view illustrating details of FIGS. 10 and 11.

The apparatus disclosed herein is for stripping end portions of insulated electrical wires W (a stripped end portion of one of which is best seen in FIG. 13), for removing the terminals ET one by one from the carrier tape T, inserting the stripped end portion of each wire W into the crimping ferrule portion CF of a terminal ET, and crimping, by indentation, the portion CF onto a stripped end portion the metal core MC of the wire. The wire W, which is intended to withstand very high temperatures, comprises a relatively soft outer jacket J and a hard, resinous, varnish-like insulation covering the strands of the metal core MC, which is multi-stranded.

The apparatus and its operation will now be described in outline with particular reference to FIGS. 2A to 2F. The basic components of the apparatus, comprise a fixed wire gripper unit 10, a horizontally reciprocating wire stripper unit 12, a pair of upper, and lower, terminal gripping and terminal crimping heads 14 and 16, respectively, a carrier strip supply rotary conveyor unit 18 and a terminal prefeed unit 20.

At the beginning of a cycle of operation of the apparatus, wire gripper jaws 22 of the unit 10 which is fixed to a front plate of the apparatus, as described below, are in a partially open position and the unit 12 is in a horizontally advanced position with wire stripper jaws 24 thereof in an open position (FIG. 2A). The heads 14 and 16 are in an open position remote from the path of movement of the unit 12. The operator inserts a wire W through an opening in the front plate and between the jaws 22 so that the end portion portion of the wire W extends between the stripper jaws 24 and there beyond, so that its free end interrupts a laser beam L behind the jaws 24. The position of the beam L is adjustable as described below for the determination of the stripped length of the wire W. Upon the free end of the wire W interrupting the beam L, the jaws 22 are instantly closed so that the wire W cannot be further advanced between the jaws 24 and the jaws 24 are closed to sever the insulation of the wire W as shown in FIG. 2A, on datum line C. It should be recalled, that the insulation comprises both the jacket J and the varnish-like insulation. The unit 12 has no wire stop for arresting the free end of the wire W, the extent to which the wire W can be advanced between the jaws 24 being determined only by the position of adjustment of the beam L. The insulation having been severed, the unit 12 is then retracted as shown in FIG. 2B, beyond datum line A, so that the jaws 24 drag the severed portion of the insulation from the core MC of the wire W, the stripped end portion of the core MC projecting from the insulation of the wire W, beyond datum line C. The insulation is always severed on datum line C regardless of the position of the beam L.

A terminal ET angularly positioned during the next previous cycle of operation by the conveyor unit 18, after having been advanced by prefeed unit 20 from its full line position in FIG. 1 to its broken line position therein, so as to be partially withdrawn from between the tapes AT and BT and so to project forwardly from the unit 20 with the free end of the said portion CF of the terminal positioned on datum line B (FIG. 2C). Wire stripping and wire crimping heads 14 and 16 are now closed so that the terminal ET is gripped between clamps 26 on inserts 28 of the heads 14 and 16 as shown in FIG. 2C, such closure of the heads 14 and 16 being enabled by the retraction of the unit 12.

With the terminal ET securely gripped between the clamps 26, the heads 14 and 16 are advanced horizontally relative to the unit 18, towards the unit 10, as shown in FIG. 2D so that the terminal ET is completely withdrawn from the tape T and the free end of the portion CF of the terminal is positioned on datum line C whereby the bared end of the core MC of the wire W guided by opposed core guides 30 of the inserts 28 is inserted into the portion CF, after which the heads 14 and 16 are pressed against each other by means described below, cause indenters 32 of the heads 14 and 16, which indenters extend through the inserts 28, to close about the portion CF to produce four regularly spaced indents therein to crimp it to the bared end of the core MC (FIG. 2E). The unit 12 is then advanced again from its retracted position, towards the unit 10 as indicated in FIG. 2F, thereby triggering the opening of the heads 14 and 16 and full opening of the jaws 22 so that the operator can pull the terminal ET through the open jaws 22, by pulling on the wire as indicated in FIG. 2F, although the tension applied to the wire will be negligible. As explained in detail below, the wire gripper jaws 22 are arranged to be opened to their full extent, to allow the withdrawal of the terminal ET therethrough, and are subsequently partially closed to a further extent, which is adjustable, to allow a further wire to be inserted between the jaws 22 for the next cycle of operation of the apparatus. The extent of this partial closure of the jaws 22, is adjusted in accordance with the gauge of the wire so that there is minimal clearance between the jaws 22 and the wire when it is inserted there between. This not only ensures that the end of the wire is correctly inserted between the insulation severing and stripping jaws 24, but also inhibits too rapid insertion of the wire W by the operator to cause the stripped length of the wire W to exceed that determined by the adjustment of the position of the beam L relative to the jaws 24. If the wire were too rapidly inserted, its end could pass to a significant extent beyond beam L prior to the closure of the jaws 22.

During a cycle of operation preceding said next previous cycle, the prefeed unit 20 moved forward with the heads 14 and 16 to advance a terminal ET, from its full line, to its broken line, position, in FIG. 1, upstream, in the direction of movement of the conveyor unit 18, of the terminal ET, after which the conveyor was indexed to bring the terminal ET, to the position of alignment of the unit 10, in which the terminal ET, is shown in FIGS. 2D and 2E.

Figure 3:
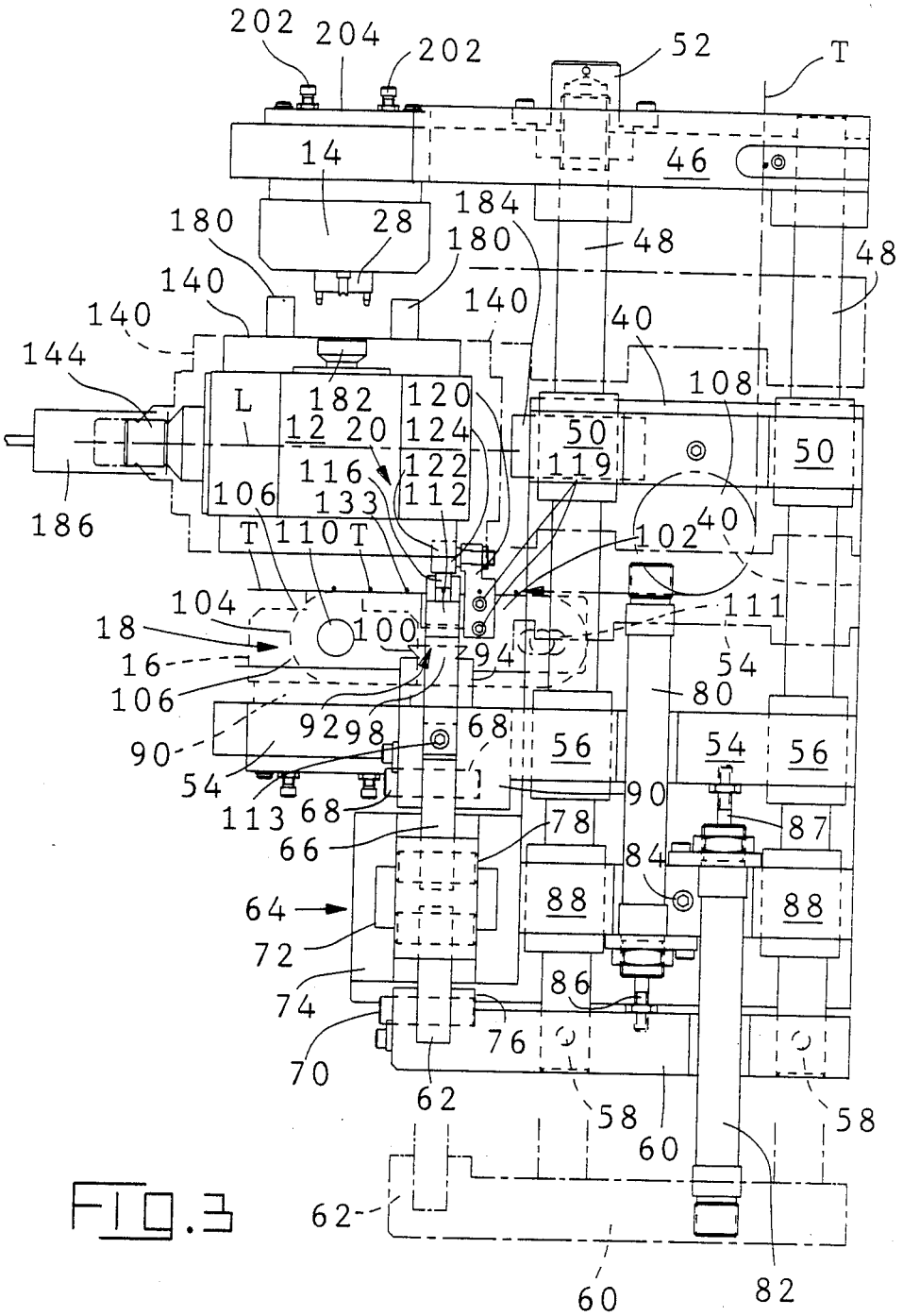
FIG. 3 is a diagrammatic rear view of the apparatus, with parts omitted, taken in the direction of the arrow 4 in FIG. 4.
Figure 4:
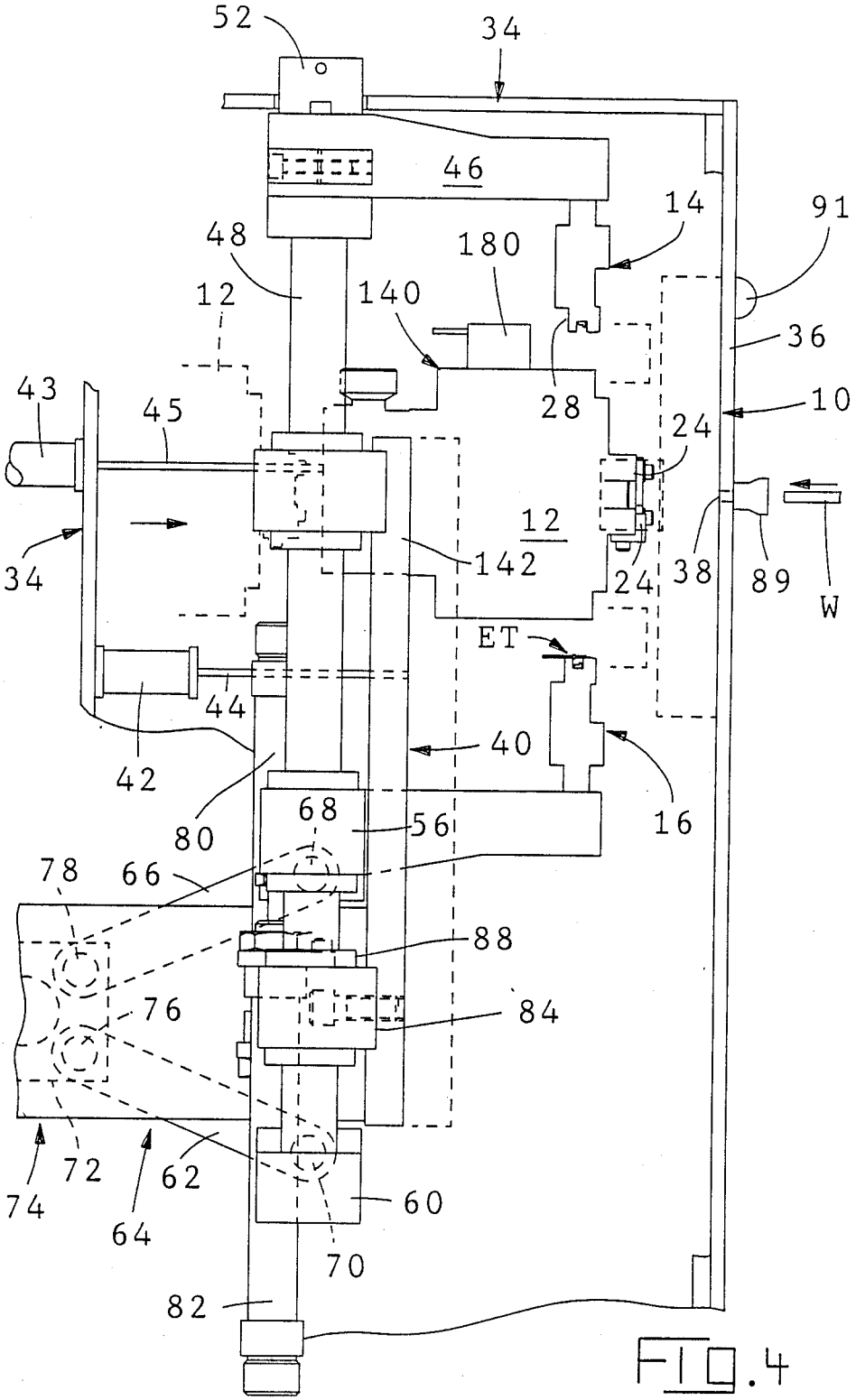
FIG. 4 is a diagrammatic side view of the apparatus, with parts omitted, taken in the direction of the arrow 3 in FIG. 4.

The general construction of the apparatus will be be described with particular reference to FIGS. 3 and 4. In these Figures, the moving parts of the apparatus are shown in full lines in their positions on FIG. 2A, that is to say in their starting positions. The apparatus comprises a main frame 34 and secured thereto, the said front plate, which is referenced 36 and to which the unit 10 is fixed, the wire access opening in the plate 36 being referenced 38 in FIG. 4. Mounted for horizontal movement in the frame 34 on bearings (not shown) is a press frame 40 for forward and retractile movement through about 18 mm, for example, by means of a piston and cylinder unit 42, secured to the frame 34 and having a piston rod 44 fixed to the frame 40. The upper terminal gripping and terminal crimping head 14 is carried by a horizontal arm 46 mounted on vertical rods 48 which are slideable in linear ball bushings 50 secured to the press frame 40. The arm 46 can be adjusted lengthwise of the rod 48 by means of a micrometer adjustment knob 52 to allow for crimp height, that is to say for terminal size. The lower terminal gripping and terminal crimping head 16 is carried by a horizontal arm 54 which is vertically slideable on linear ball bushings 56, along the rods 48. The rods 48 are connected by fasteners 58 to a cross-piece 60 to which is pivotally connected, the lower link 62 of a press drive toggle link mechanism generally referenced 64, the upper link 66 of the mechanism 64 being pivotally connected to the arm 54 by means of a pivot pin 68, the link 62 being connected to the cross-piece 60 by means of a pivot pin 70. The links 62 and 66 are pivotally connected, by means of pivot pins 76 and 78, respectively, to a slide 72 which is drivable horizontally by means of a piston and cylinder unit 74. By activating the unit 74 to advance its piston rod, the slide 72 is driven rightwardly (as seen in FIG. 4), to open the links 62 and 66 from the position in which they are shown in FIGS. 3 and 4, so that the link 62 lowers the arm 46 to its broken line position and the link 66 raises the arm 54 to its broken line position, to move the heads 14 and 16 from their open to their closed position. There are provided, in order to assist this movement of the arms 46 and 54 towards each other by means of the mechanism 64, to press the inserts 28 together as described above with reference to FIG. 2E, upper and lower toggle drive assist piston and cylinder units 80 and 82, respectively. The units 80 and 82, which are oppositely acting, have their cylinders secured to a cylinder support tar 84, which as best seen in FIG. 4, is fixed to the press frame 40. The piston rod 86 of the cylinder 80 is fixed to the cross-piece 60 and the piston rod 87 of the unit 82 is fixed to the arm 54. When the piston rod 87 is advanced, it assists the link 66 in driving the arm 54 and thus the head 16 towards the head 14, and when the piston rod 86 is advanced, it assists the link 62 in driving the cross-piece 60 and the arm 46, and thus the head 14 towards the head 16. The arms 48 extend through linear ball bushings 88 fixed to the support 84. The position of the beam L is adjustable by means of a knob 89 on the front plate 36, through a mechanism described below, the extent to which the jaws 22 be closed from their fully open, to their partially open, position being adjustable by means of a hand wheel 91 projecting from the plate 36, by means of a mechanism described below.

Figure 5:
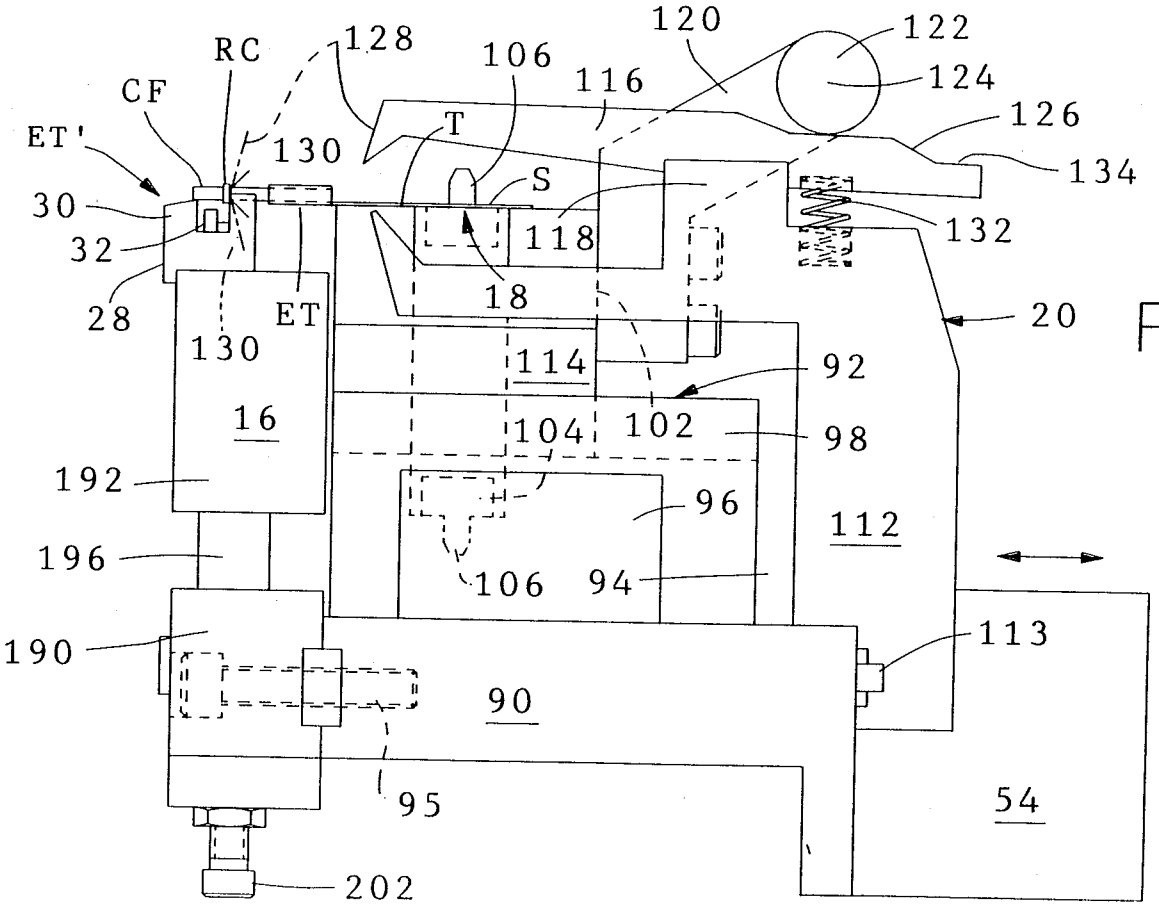
FIG. 5 is a diagrammatic side view of electrical terminal supply and prefeed units of the apparatus, in association with a bottom press jaw thereof.
Figure 6:
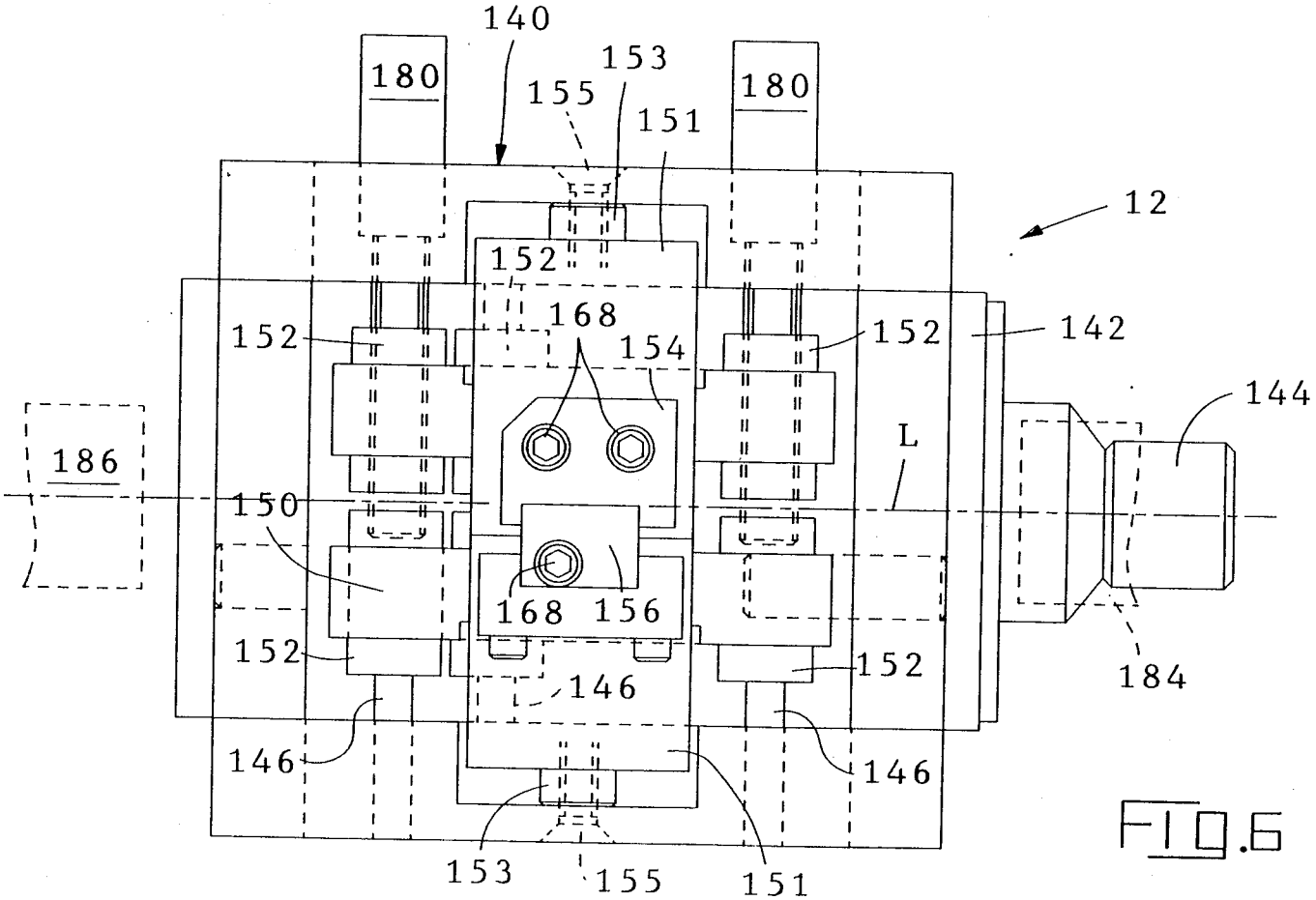
FIG. 6 is a diagrammatic front view of a wire stripper unit of the apparatus.
Figure 7:
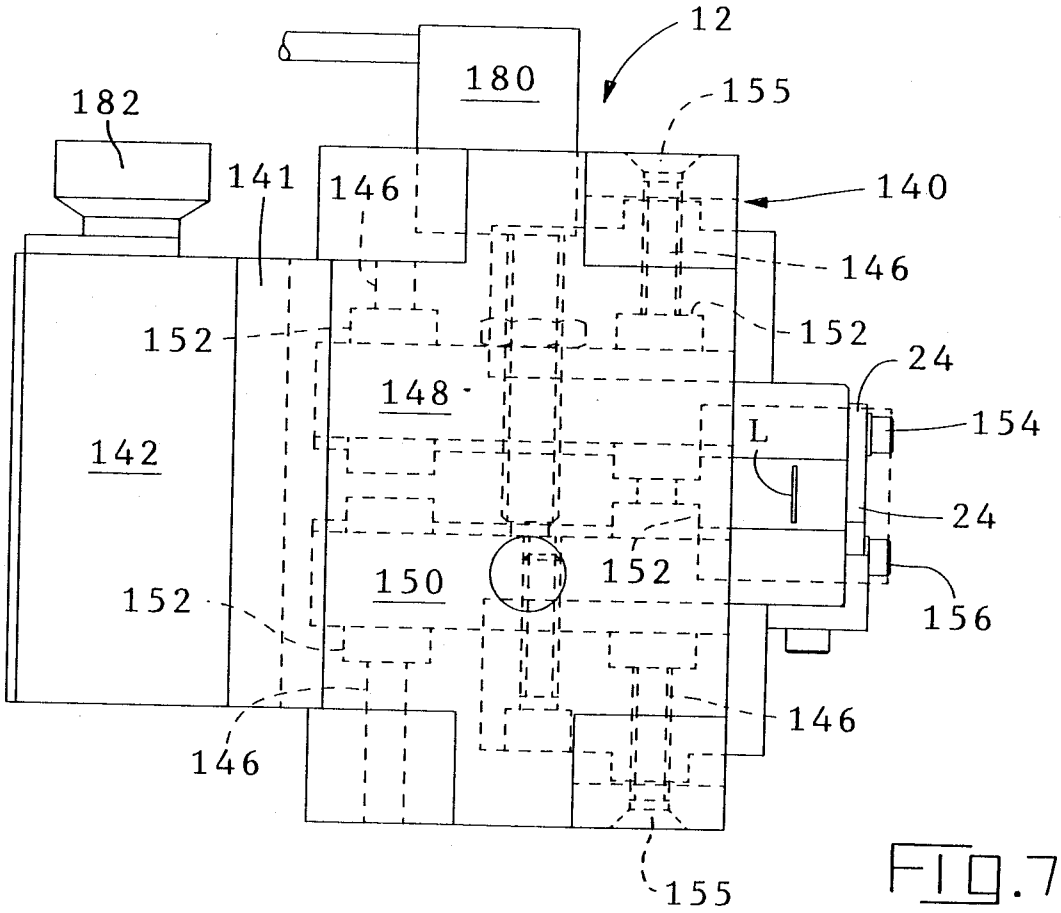
FIG. 7 is a diagrammatic side view of the wire stripper unit.

The conveyor unit 18 and the terminal prefeed unit 20 will now be described with particular reference to FIGS. 3 and 5. These units are mounted on a base 90 which is, in turn, mounted in the arm 54 carrying the lower crimping head 16 which is exchangeably mounted to the base 90 by means of fasteners 95. The conveyor unit 18 is mounted to the base 90 and thus to the arm 54, by means of a dovetail connection which is generally referenced 92 so that although the unit 18 is raised and lowered with the arm 54, it does not move horizontally therewith as will be apparent from a comparison of FIGS. 2C and 2D, the unit 18 being connected to the main frame 34 for vertical movement thereon by means of roller bearings (not shown). Thus the conveyor unit 18 is always intersected by datum line A which will be apparent from FIGS. 2C to 2E and from FIG. 5. In FIG. 5, the lower head 16 is shown in its FIG. 2C horizontal position in which datum line B lies just behind the guide 30 of the insert 28 of the head 16. The dovetail connection 92 comprises a dovetail slideway block 94 having a horizontal channel 96 therethrough and being formed on its upper surface with a dovetail rib 98 which engages in a complementarily shaped groove 100 in a conveyor carrier block 102 which is fixed to the main frame 34 by means of said roller bearings. The block 94 is thus slidable relative to the block 102 as the head 16 is moved between its FIG. 2C and its FIG. 2D positions. The conveyor 18 comprises an endless belt 104 having teeth 106 which engage in the indexing slots S in the tape T which depends from a rotary storage reel (not shown) and over an idler role 108 which is mounted to the block 102 by means of a bracket (not shown).

The conveyor belt 104 is intermittently driven by a stepping device 110 to advance the tape T in a leftward (as seen in FIG. 3) direction by the distance between the slots S in the tape T at each step. At its end opposite to the device 110, the conveyor belt 104 is carried by a shaft 111 which is adjustable towards and away from the device 110, for belt tension as indicated in broken lines in FIG. 3.

The prefeed unit 20 comprises a support plate 112 which is fixed to the base 90 by means of a screw 113, upstream, in the conveying direction of the terminal gripping and terminal crimping head 16, as shown in FIG. 3. There are provided on the plate 112, a fixed, terminal prefeed finger 114 and a movable terminal feed finger 116 pivoted to the plate 112 at 118 Fixed to the block 102 by means of screws 119 (FIG. 4) is a cam follower support 120 upon which is mounted for free rotation about a pivot pin 124, a circular cam follower 122 for co-operation with a cam surface 126 on the finger 116. At its end remote from the cam surface 126 and on the other side of, the pivot pin 118, the finger 120 has a downwardly projecting, terminal engaging nose 128 disposed oppositely to an upwardly projecting terminal engaging nose 130 at the free end of the finger 114. The finger 116 is urged in an anticlockwise (as seen in FIG. 5) sense of rotation about the pin 118 by a coil spring 132 acting between the finger 126 and the plate 112. When a terminal ET' has been positioned by the 126 and the plate 112. When a terminal ET, has been positioned by the conveyor unit 18, in front of the fingers 114 and 116, as the head 16 is advanced from its FIG. 2C to its FIG. 2D position, the terminal ET being in its full line position in FIG. 1, the fingers 114 and 116 are moved towards the terminal ET' in the open position in which they are shown in FIG. 5, until the noses 128 and 130 of the fingers 114 and 116 approach the radial collar RC of the Terminal ET' at which time, the cam follower 122 rides onto a reduced height flat end portion 134 of the cam surface 126 so that the finger 116 is urged by the spring 132 in its anticlockwise sense of rotation about the pin 118 whereby the noses 128 and 130 are relatively closed about the terminal ET' and engage the collar RC thereof as indicated in broken lines in FIG. 5 so that as the head 16 continues its advance, the terminal ET' is drawn from between the tapes AT and BT to assume its broken line, FIG. 1 position. Although the travel of the head 16 is such that the terminal ET is advanced so that the tip of its crimping ferrule portion CF projects slightly beyond datum line B, a cam bar 133 (FIG. 3) secured to the block 102 alongside the belt 104 and downstream of the fingers 114 and 116, forces the terminal ET', to a small extent, back, so that the tip of its ferrule portion CF is coincident with datum line B, correctly to position the terminal ET', for a further cycle of operation of the apparatus.

Figure 9:
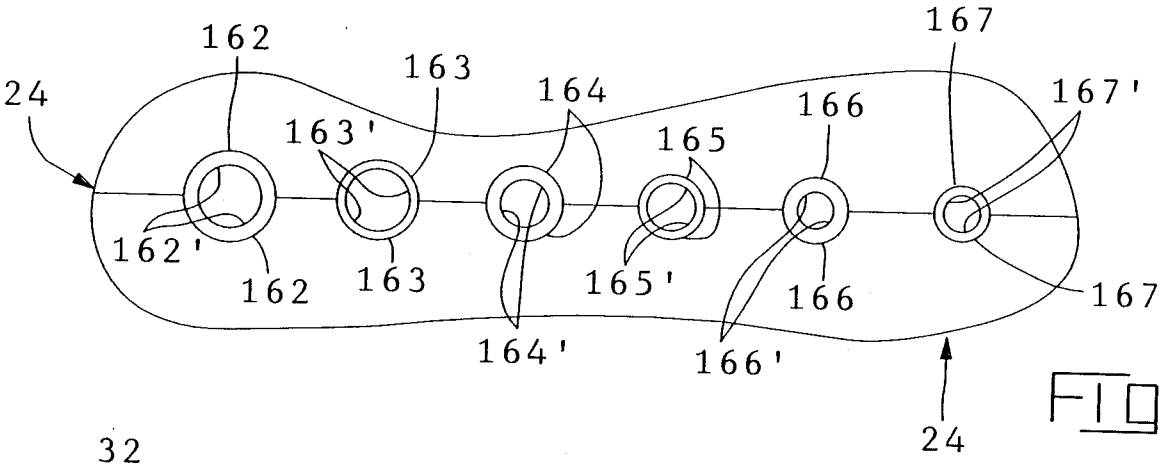
FIG. 9 is a diagrammatic front view of the wire stripper jaws, in a closed position.
Figure 17:
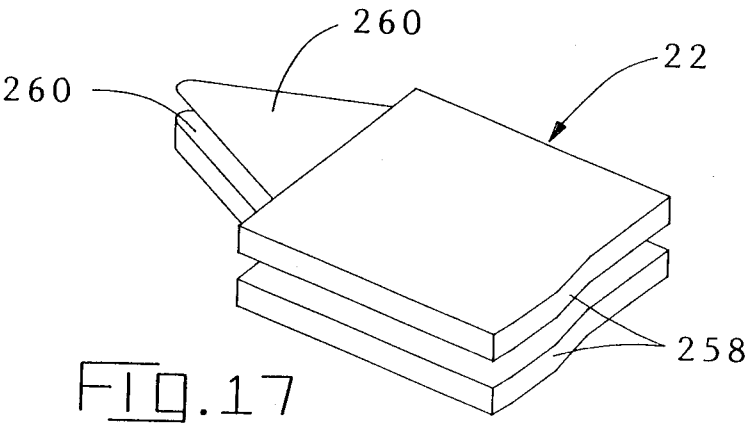
FIG. 17 is an enlarged fragmentary, isometric view of a wire gripper jaw of the wire gripper unit.

The wire stripper unit 12 will now be described with particular reference to FIGS. 6 to 9. The stripper unit 12 comprises a frame 140 mounted on a slide 141 which is slidable horizontally, and laterally of the apparatus, relative on a slide unit 142, as indicated in broken lines in FIG. 3, by means of a click-stop micrometer adjustment knob 144. In the frame 140 are vertical slide rods 146, upon which are slidably mounted, in opposed relationship, upper and lower stripper jaw slides 148 and 150, respectively, for vertical movement on linear ball bearings 152, along the rods !46. The slides 148 and 150 are movable towards and away from one another by means of pneumatic piston and cylinder units 151 attached to the slides 148 and 150 and having piston rods 153 secured to the frame 140 by means of screws 155. There is provided on the upper slide 148, a first jaw carrier plate 154 and on the lower slide 150, a second jaw carrier plate 156, engaging in a recess 158 in the plate 154 in order correctly to align the stripper jaws 24, each of which is secured to the rear of a respective one of the plates 154 and 156. Each stripper jaw comprises a pair of mild steel, insulation severing blades supports 158 and 159 (FIG. 8) and sandwiched therebetween, a hardened steel insulation severing blade 160 blade, made for example, from razor blade material. Each support 158 and 159 is provided with a row of wire receiving notches 162 to 167 of arcuate shape, and which, as seen in FIG. 9, increase in radius form right to left, although these gradations in radius are not to be seen in FIG. 8, in which the notches are shown only diagrammatically. Each jaw 24 is secured to its respective plate 154 or 156, by means of studs 168 passed through openings 170 in the supports 158 and 159 and openings 172 in the blades 160, lugs 174 on the supports 158 engaging in recesses 176 and 178, respectively, in the blades 160 and the supports 159 to hold each pair of supports 158 and 159 in precise alignment with the respective blade 160, so that a pair, of equal radius, of the notches 162 to 167 is aligned with a corresponding notch 162, to 167, in the blade 160, each notch 162, and 167, being of smaller radius than the corresponding notch 162 to 167 as best seen in FIG. 9, in which the jaws 24 are shown in their closed position. Proximity sensors 180 are provided in the frame 140 sensing the open and the closed positions of the jaws 24. The slide unit 142 serves for positioning a desired set of aligned wire receiving notches in alignment with the opening 38 in the front plate 36, in accordance with the gauge of the wire W from which insulation is to be stripped, the slide 141 being retained in a desired horizontal position corresponding to the selected wire gauge, by means of a lock nut 182 on the slide unit 142.

The laser beam L is generated by a laser emitter 184, the interruption of the beam L being detected by a laser sensor 186, the emitter 184 and the sensor 186 being adjustably forwardly and rearwardly of the apparatus by means described below, in order to determine the length of the core MC of the wire W, that is to be stripped. When the jaws 24 are closed about the wire W, the edges of the respective notches in the blades 160, which have been aligned with the opening 38 in the front plate 36, cut cleanly through the jacket J of the wire W and and cut cleanly through the varnish-like insulation on the strands of the core MC thereof, and as the unit 12 is retraced, scrape that insulation cleanly from the strands.

Figure 12:
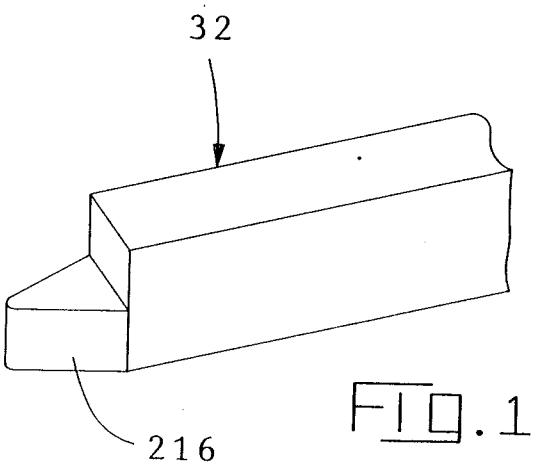
FIG. 12 is a fragmentary isometric view of an electrical terminal indenter of the crimping unit.
Figure 10:
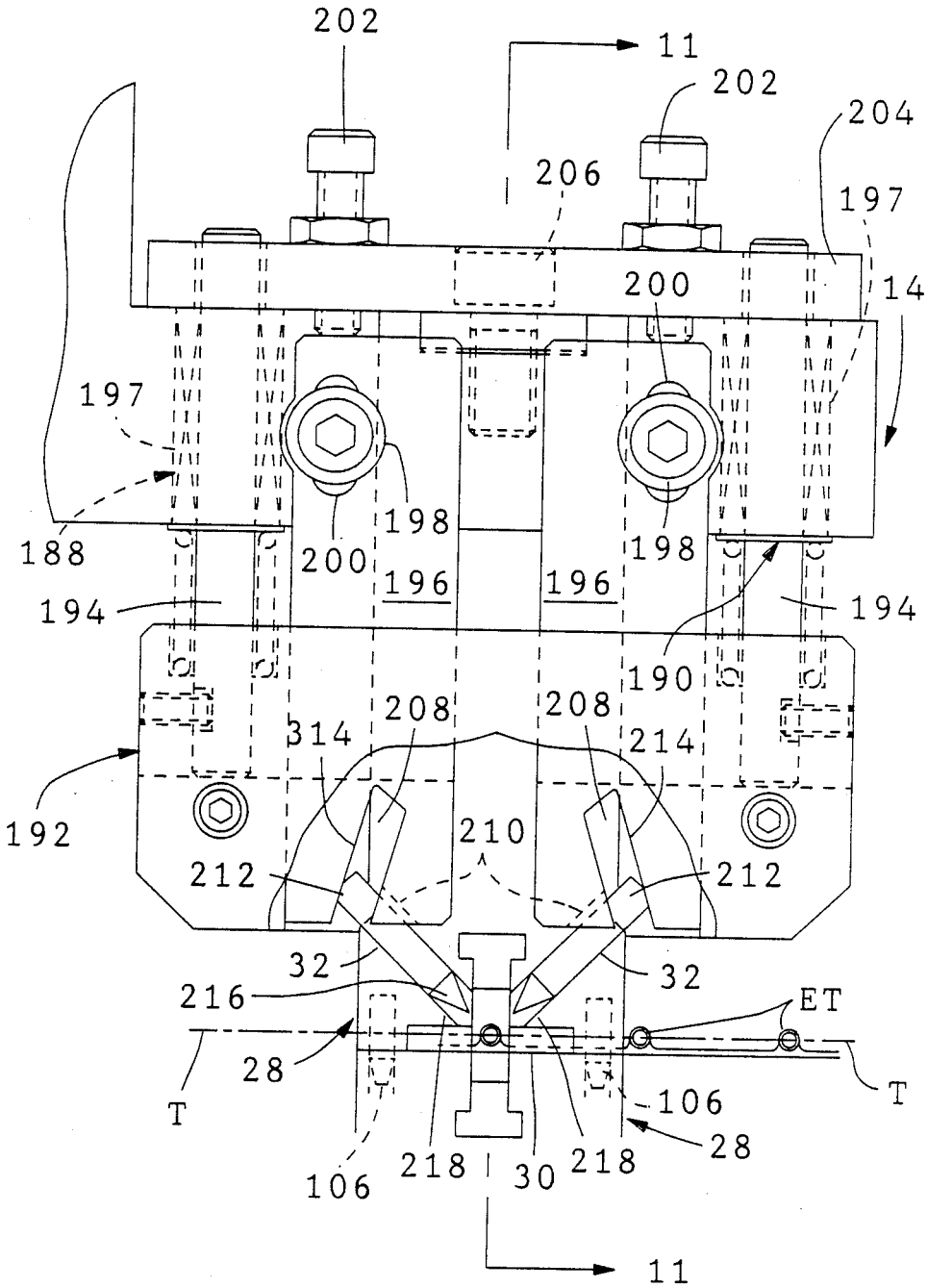
FIG. 10 is a diagrammatic front view of an upper, electrical terminal gripping and crimping unit of the apparatus, shown partly in section and depicting part of a lower, electrical terminal gripping and crimping unit of the apparatus, and also showing part of the terminal supply unit.
Figure 11:
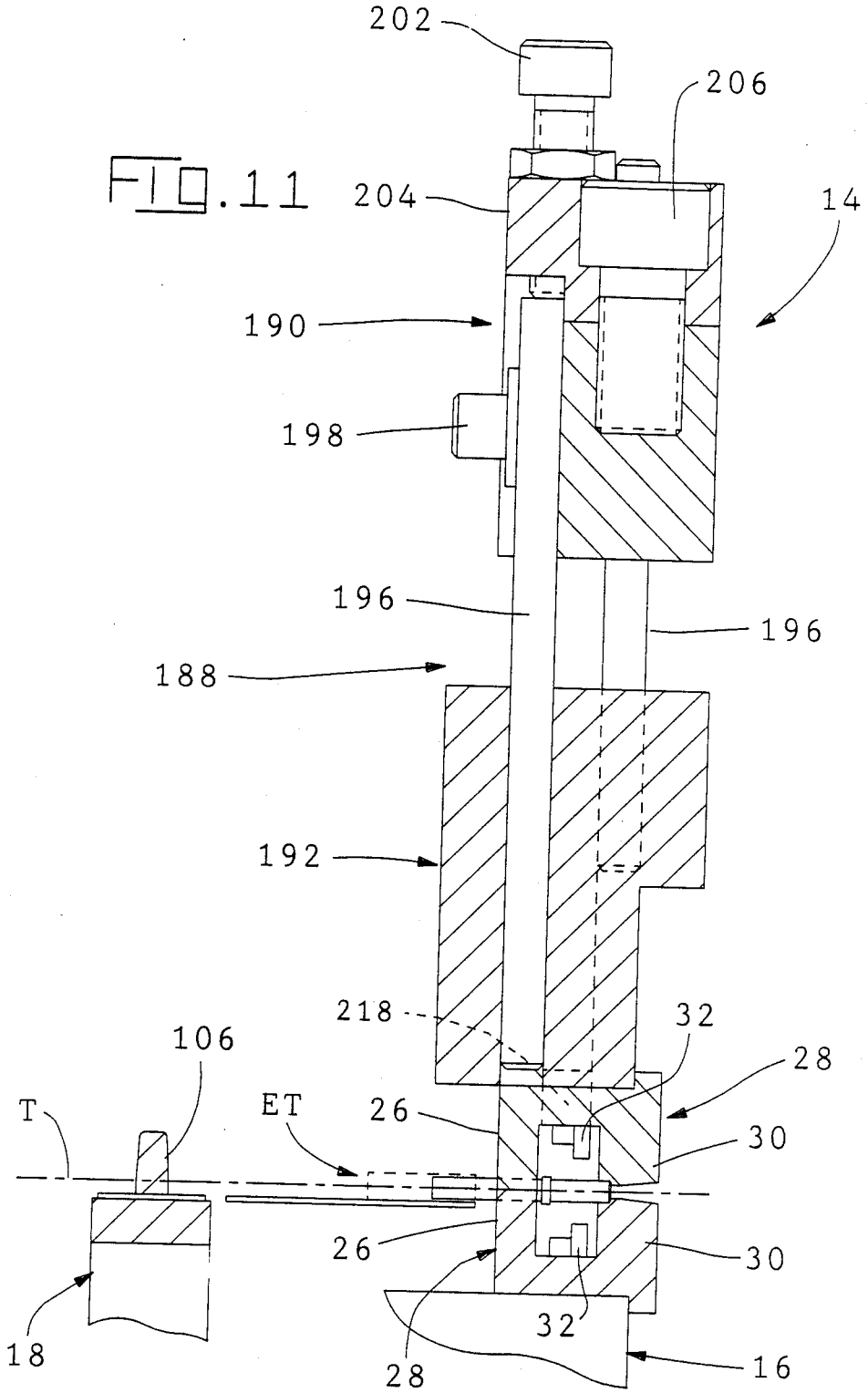
FIG. 11 is a view taken on the lines 11—11 of FIG. 10.

The terminal gripping and terminal crimping heads 14 and 16 will now be described with particular reference to FIGS. 10 to 13 and mainly with reference to the upper head 14. The head 14 comprises a body 188 having an upper part 190 and a lower part 192, the part 190 being vertically slidable towards the part 192 on rods 194 against the action of compression springs 197 (FIG. 10). There are fixed to the part 190 two opposed pairs of coplanar indenter cam plates 196, by means of fasteners 198 which extend through vertical slots 200 in the plates 196, so that the vertical position thereof can be adjusted by means of screws 202 threaded through a top plate 204 of the part 190, the plate 204 being secured to the part 190 by means of a screw 206. Within the body part 102, each plate 196 is formed with a cam slot 208 which extends obliquely downwardly (as seen in FIG. 10) and opens into the bottom end of the plate 196, the slots 208 of each pair of coplanar plates 196 being downwardly divergent. There is slidably arranged in a groove 210 in each plate 196, one of the four indenters 32, each indenter 32 having a cam follower end surface 212 engaging an outer camming edge 214 of the respective slot 208. As best seen in FIG. 12, each indenter 32 has an indenting nose 216 projecting from its end opposite to the cam follower surface 212. A part of each indenter 32, back from its nose 216, extends through an opening 218 in the insert 28 of the jaw 14 so that the nose 216 projects into said insert. The terminal gripping and terminal crimping head 16 is identical with the head 14, but is arranged there below in mirror image relationship therewith, so that in relation to the head 16, the words "upper" and "lower", as used in the above description relating to the head 14, are reversed in the case of the head 16.

When the heads 14 and !6 have been brought to their closed positions about the terminal ET and are pressed together (FIG. 2*e*) with the aid of the piston and cylinder units 80 and 82, the parts 190 and !92 of each head 14 and 16, are driven towards one another against the action of the springs 197, since the inserts 28 are in abutment, so that the indenters 32 are simultaneously forced radially inwardly of the crimping ferrule portion CF as the cam follower surfaces 212 thereof slide on the cam surfaces 214, whereby the nose 216 of each indenter 32 is driven into the crimping ferrule portion CF of the terminal ET so that it is firmly and permanently crimped to the bared portion of the core MC of the wire W.

The mechanism for adjusting the position of the beam L for wire stripped length, will now be described with particular reference to FIGS. 14 and 15. The laser beam emitter 184 and the laser beam sensor 186 are mounted on a two armed yoke 220 the lower end of which is mounted to the front plate 36 by way of pivot pins 222 in a bearing block 224 fixed to the plate 36 by means of screws 226, the yoke 220 being swingable about the pins 222 away from the panel 36 against the action of springs 228. The knob 89 is secured to a screw threaded spindle 230 meshing with an internally tapped bushing 232 (FIG. 15) so that rotation of the knob 89 by one revolution, will, for example, move the bushing 232 by one millimeter towards or away from the panel 36 according to the sense of rotation of the knob 89. The bushing 232 is enclosed in a housing 234 fixed to the panel 36 by means of screws 236 and having opposed slots 238 therein through which extends a pin 240 fixed to a yoke displacement nose 242 engaging a plate 244 secured to one arm 248 of the yoke 220 by means of screws 246 and carrying the sensor 186 which is thereby secured to the arm 248 of the yoke 220, the emitter 284 being connected to the other arm 250 of the yoke 220 by means of a plate 252 secured thereto by screws 254. By turning the knob 89, the beam L can be moved towards and away from the jaws 24 to adjust the stripped length of the core MC of the wire W.

Figure 15:
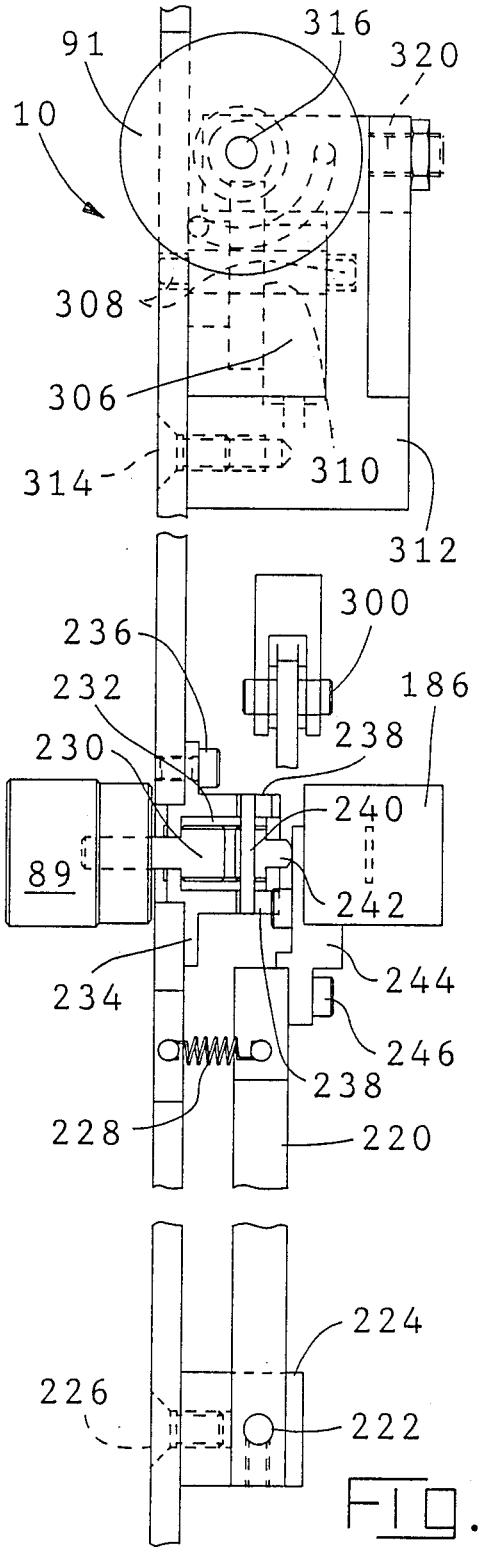
FIG. 15 is a diagrammatic side view showing part of the gripper unit and wire stripped length adjustment mechanism of the apparatus.
Figure 16:
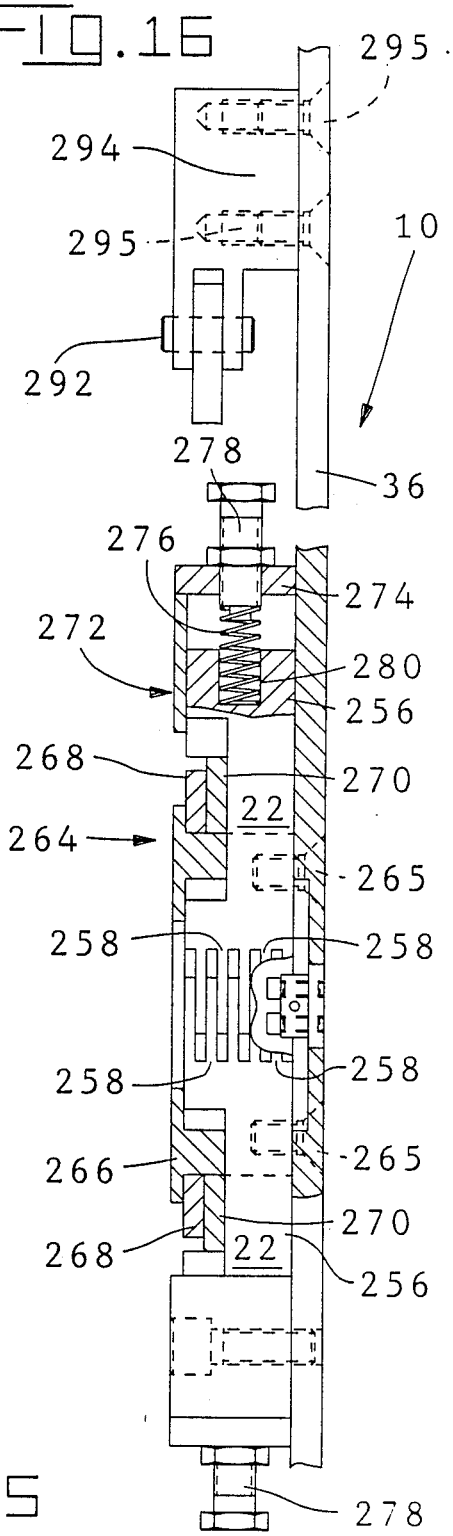
FIG. 16 is a diagrammatic view taken on the lines 16—16 of FIG. 14.

The wire gripper unit 10 will now be described with particular reference to FIGS. 14 to 17. Each of the jaws 22 comprises a shank 256 (FIG. 16) from which project a series of five spaced jaw plates 258 from each of which projects a wire gripping, triangular shaped, finger 260. The fingers 260 of the jaws 22 slidably interdigitate to define a square, wire receiving opening 262 (FIG. 14), the jaws 22 being slidable towards and away from one another on the front plate 36 in a housing generally referenced 264 thereon, by means of screws 265, the fingers 260 being contained in a circular portion 266 of the housing 264. Mounted for rotation about the portion 266 is an outer (as seen in FIG. 16) cam wheel 268 having formed in its peripheral cam surface, two diametrically opposite sets of five steps 271, an inner (as seen in FIG. 12) cam wheel 270 also being mounted for rotation about the housing portion 266 in juxtaposed parallel relationship with the cam wheel 268. The inner cam wheel 270 has diametrically opposed steps 269. The housing 264 has end casings 272 receiving respective end portions of the jaw shanks 256, each casing 272 having adjustably secured to an end wall 274 thereof, by means of a screw 278, a loading spring 276, each spring 276 engaging in a well 280 in the respective jaw shank 256, so that the springs 276 urge the jaws 22 towards one another. The screws 278 serve to adjust the tension of the springs 276, in turn to adjust the force that the fingers 260 of the jaws 22 exert against a wire W to be gripped by the unit 10 in the fully closed position of the jaws 22. On each shank 256 is a cam follower 282 which is engagable with the cam wheel 268 or 270 according to the angular position thereof. A piston and cylinder unit 284 has its piston rod 286 pivotally connected by a pin 288 to a lug 290 projecting radially outwardly of the inner cam wheel 270. The cylinder of the unit 284 being pivotally connected by a pin 292 to a bracket 294 secured to the front plate 36 by means of fasteners 295. A further piston and cylinder unit 296 has its piston rod 298 pivotally connected by a pin 300 to a lug 302 projecting radially from the outer cam wheel 268, the cylinder of the unit 296 being connected by means of a pivot pin 304 to a lever 306 loaded by a spring 307 and connected to a spindle 308 of a toothed wheel 310, the spindle being rotatable in a bracket 312 secured by screws 314 to the front plate 36. The hand wheel 91 has a shaft 316 to which is keyed a worm wheel 318 meshing with the teeth of the wheel 310. The hand wheel 91 is rotatable stepwise, by virtue of a ball detent 320 mounted in the bracket 312 and being engagable in recesses (not shown) in the periphery of the wheel 91. Inductive sensors 322 are provided on each side of the opening 262 for sensing the presence of a wire W therein.

Figure 14:
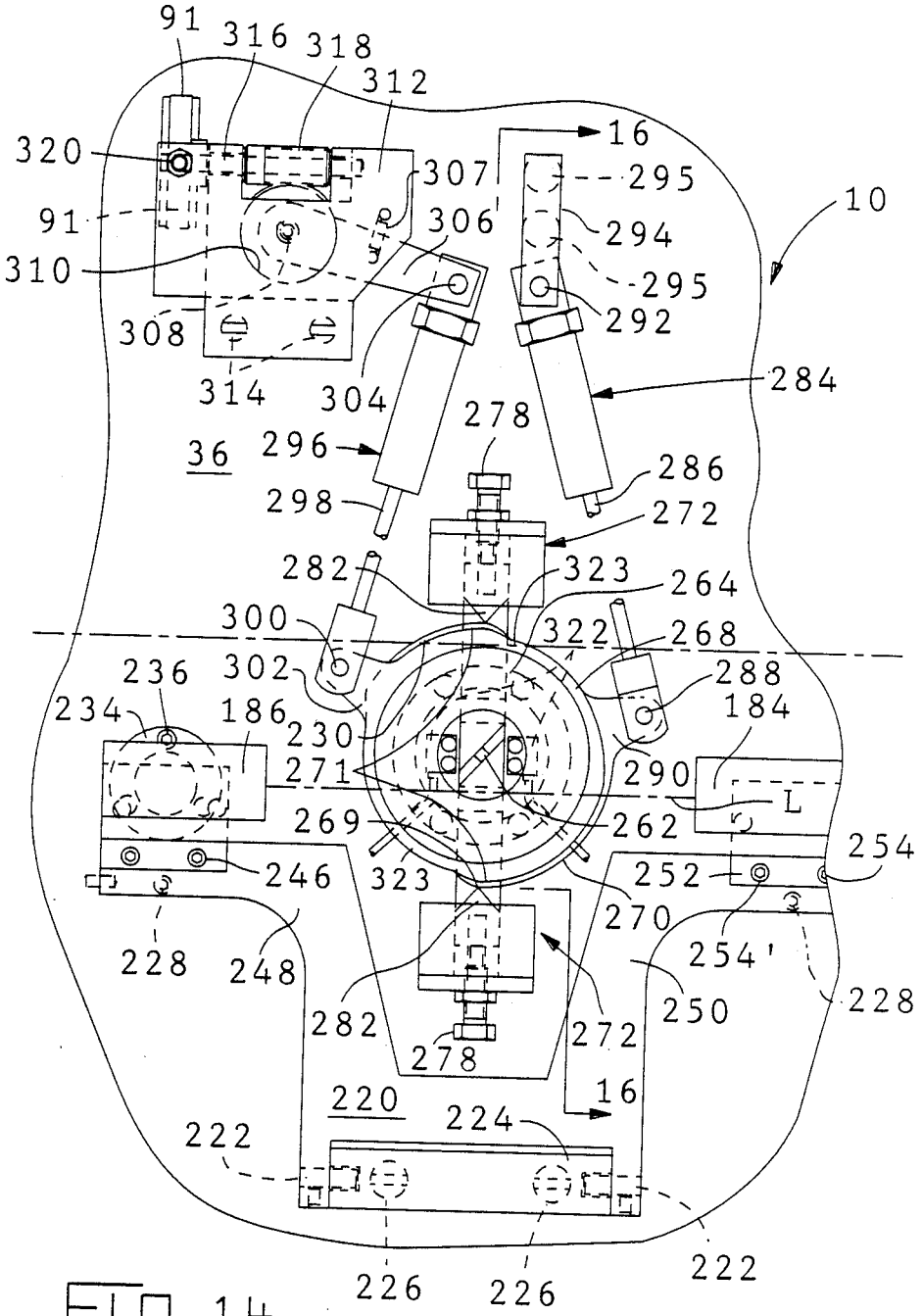
FIG. 14 is a diagrammatic front view of a wire gripper unit of the apparatus.

FIG. 14 shows the piston and cylinder unit 284 in a position in which the jaws 22 are fully open to allow the terminal ET crimped to the wire W to be pulled between the jaws 22, each cam follower 282 resting on a selected step 271 of the cam wheel 268. The extent to which the jaws 22 close, in their partially closed position can be adjusted for the purpose mentioned above, by means of the hand wheel 91 acting through the toothed wheel 310, the worm wheel 318, the lever 306 and the unit 296, to alter the angular position of the cam wheel 268 to place a desired step 271 opposite to each cam follower 282 thereby to determine the extent to which the jaws 22 interdigitate with one another in their partially closed position and thus the area of the opening 262, in that position, to allow for wire gauge. When the jaws 22 are to be partially closed, the unit 284 is actuated to retract its piston rod 286 in an anticlockwise (as seen in FIG. 14) sense, to a position in which its steps 269 pass the cam followers 282 to allow them to engage said selected steps 271 of the cam wheel 268, the unit 296 being actuated to retract its piston rod 298 to bring about full closure of the jaws 22 when the beam L is interrupted the end of a wire W.

When a wire W with a terminal ET crimped thereto is withdrawn through the opening 38, as described with reference to FIG. 2F, the jaws 22 being in their fully opened position to allow of this, the sensors 322 are deactivated by the withdrawal of the wire W and the terminal ET therebetween, to cause the unit 284 to retract its piston rod 286 so that the jaws 22 partially close to an extent determined by the setting of the knob 89. When a further wire W has been inserted through the partially closed opening 262, by way of the opening 38 in the front plate 36, and into the unit 12 to, interrupt the beam L, the sensor 186 is deactivated to cause the piston and cylinder unit 296 to advance its piston rod 298 to rotate the cam wheel 268 in an anticlockwise (as seen in FIG. 14) sense to position a low portion 323 of the profile of the cam wheel 268 opposite to each cam follower 282, to allow the jaws 22 to be fully closed under the action of the springs 276, about the wire W, to exert a pressure thereagainst determined by the settings of the screws 278.

When the unit 12 is advanced again towards the unit 10, as described with reference to FIG. 2F, with its jaws 24 in their open position, the unit 284 is triggered by a limit switch (not shown) to advance its piston rod 286 to rotate the cam wheel 270 in a clockwise (as seen in FIG. 14) sense so that the cam followers 282 ride up on the steps 269 of the wheel 270, fully to open the jaws 22 to allow the terminal ET crimped to the wire to be pulled out from between the jaws 22 and the unit 296 is triggered to retract its piston rod 296 to reset the cam wheel 268 so that the cam followers 282 again engage the steps 271 selected by means of knob 91.

The sequence of operation of the parts of the apparatus, as described above is carried out under the control of a programmable logic controller in accordance with the program thereof.

I claim:

1. Apparatus for stripping the insulation from an end portion of an insulated electrical wire, withdrawing an electrical terminal from a carrier tape therefor, and crimping the terminal to the stripped end portion of the wire, the apparatus comprising a wire gripper first unit, an insulation severing and stripping second unit, a terminal prefeed third unit, a pair of terminal gripping and terminal crimping heads and a carrier tape conveyor, the second unit being movable back and forth along a path of movement, between an advanced position proximate to the first unit, to receive and sever the insulation of the end portion of an insulated wire gripped by the first unit, and a retracted position remote from the first unit to strip the insulation from said end portion, said heads being movable between an open position in which they are clear of said path and a closed, terminal gripping position intersecting said path, the third unit being actuable partially to withdraw said terminal from said tape for positioning by said tape conveyor between said heads in the open position thereof and in the retracted position of the first unit, so that said heads grip the terminal when moved to their closed position, said heads being movable in that position, towards the first unit fully to withdraw the terminal from the tape and to insert the stripped wire end portion into the terminal and being then actuable to crimp the terminal to the stripped wire end portion.

2. Apparatus as claimed in claim 1, wherein said conveyor is arranged to advance the tape stepwise, and transversely of the path of movement of the second unit, to position the terminal in register with said third unit and to retain the tape against movement towards said first unit, to allow said third unit partially to withdraw the terminal from the tape.

3. Apparatus as claimed in claim 1, wherein each terminal gripping and terminal crimping head comprises a terminal clamp and a stripped wire end portion guide, said guides serving to grip the terminal, and to guide the stripped wire end portion into the terminal respectively, in the closed position of said heads, each head having at least one terminal indenter, between the clamp and the guide thereof, means being provided for urging said heads against one another to cause said indenters to crimp the terminal to the stripped wire end, when said heads have moved towards said first wire gripper unit.

4. Apparatus as claimed in claim 1, wherein the insulation severing and stripping unit comprises a pair of insulation severing jaws having an open wire end receiving position and a closed insulation severing position, means being provided for generating a laser beam extending, in the advanced position of the severing and stripping unit, on the side of said jaws remote from the first unit, and for sensing the interruption of said beam by a wire end inserted between said jaws when in their open position, to initiate instantaneous closure thereof about the wire, and closure of wire gripping jaws of the wire gripper unit thereabout.

5. Apparatus as claimed in claim 1, wherein the terminal prefeed unit which is fixed to one of the terminal gripping and terminal crimping heads, comprises a prefeed finger for partially withdrawing a terminal from the tape as the terminal gripping and terminal crimping heads are moved towards the wire gripper unit, said heads being movable theretowards with respect to said conveyor.

6. Apparatus as claimed in claim 1, wherein the wire gripper unit comprises a pair of wire gripping jaws urged toward a closed, wire gripping position by resilient means, each jaw having thereon a cam follower which engages a first cam in the open position of the jaws, the first cam being movable to allow the cam followers to engage the periphery of an adjustable second cam so as partially to close the jaws to an extent determined by the position of adjustment of the second cam, the second cam being movable from said position of adjustment to a jaw full closing position to allow full closure of the jaws under the action of said resilient means the first cam and the second cam cooperate with cam actuating means to move the cams between respective positions.

7. Apparatus as claimed in claim 6, wherein the second cam is in the form of a cam wheel having a plurality of steps formed in its periphery, means being provided for the stepwise adjustment of the angular position of the cam wheel to bring a selected step into register with each cam follower so that the latter engages the selected step upon said movement of the first cam.

8. Apparatus as claimed in claim 6, wherein the wire gripper jaws are slidably arranged in a housing fixed to a front plate of the apparatus, both of the cams being in the form of cam wheels which are rotatable in parallel, juxtaposed relationship about a central portion of the housing, each wire gripping jaw comprising a shank extending into an end portion of the housing and being urged by a spring therein towards the other wire gripping jaw, to urge said cam followers towards the peripheries of said cam wheels, the first cam being drivable in rotation by a piston and cylinder unit between an angular position in which the cam followers rest upon raised portions of the periphery of the first cam and an angular position in which said cam followers are displaced from said raised portions, the second cam being moved to its jaw closing position and subsequently reset, by a second piston and cylinder unit pivotally connected at one end to the second cam and at its other end to a lever, the angular position of which is adjustable to determine said position of adjustment of the second cam.

9. Apparatus as claimed in claim 6, wherein each wire gripping jaw comprises a plurality of substantially triangular shaped wire gripping fingers which interdigitate with said pairs of fingers of the other wire gripping jaw, to define a rectangular wire receiving opening through which the terminal can be pulled by pulling on the wire, in the fully open position of the wire gripping jaws, the size of said opening only slightly exceeding the gauge of the wire in the partially closed position of the wire gripping jaws.

10. Apparatus as claimed in claim 1, wherein each terminal gripping and terminal crimping head comprises a first part secured to means for driving said heads between their open and their closed positions and a second part which is slidable towards the first part against the action of resilient means, an exchangeable insert mounted to the second part, comprising a terminal clamp and a wire core guide, a camming plate fixed to said first part extending slidably through said second part and having a cam surface engaged by one end of a terminal indenter, the other end of which projects from said camming plate, the clamps of said inserts serving to grip the terminal in the closed position of said heads and said driving means being arranged to press said inserts against one another when the jaws have been moved towards the wire gripper unit, to press the first part of each jaw towards the second part thereof so that said cam surfaces force the other ends of said inserters against said terminal to crimp it to the stripped wire end portion.

11. Apparatus as claimed in claim 10, wherein the first part of each terminal gripping and terminal crimping head is connected to an arm, which is in turn connected to a toggle link pivoted to a piston and cylinder unit actuable to drive said arms towards one another to move said heads to their closed position, a further piston and cylinder unit connected to each arm, being actuable to press said heads towards one another to drive said indenters against the terminal.

12. Apparatus as claimed in claim 1, wherein the insulation severing and stripping unit comprises a pair of insulation severing blades, each comprising a row of arcuate, wire receiving notches each of a different radius, each wire receiving notch of one blade being opposite to a wire receiving notch of the other blade, of the same radius, the insulation severing and wire stripping unit being mounted on a slide which is adjustable to position a pair of said notches of the same radius in register with the wire gripper unit.

13. Apparatus as claimed in claim 1, wherein the insulation severing and stripping unit comprises a pair of insulation severing jaws which are closable about the wire gripped by the wire gripper unit, to sever the insulation of the wire, each jaw comprising a pair of mild steel blade supports, between which is sandwiched, an insulation severing blade made of a hardened steel, each blade support having a wire receiving notch arranged in alignment with a wire receiving notch of the other blade support and with a wire receiving notch of the hardened steel blade, which notch is of smaller radius than the wire receiving notches of the blade supports.

14. Wire end processing apparatus comprising a wire gripper unit having wire gripper jaws and means for moving the jaws between a fully opened position, a fully closed position, and a partially open, wire receiving position, in which a wire, an end portion of which is to be processed, can be inserted between the jaws; and a wire processing unit aligned with the wire gripper unit for receiving and processing said end portion of the wire when it has been inserted between said jaws, means being provided for generating and sensing a laser beam extending through the wire processing unit and for causing said jaws fully to close when the end of the wire interrupts the laser beam, means also being provided for adjusting the extent to which the jaws can close to said wire receiving position, to ensure that there is minimal clearance between the jaws and the wire in dependence upon the gauge thereof.

15. Apparatus as claimed in claim 14, wherein said adjusting means comprises a cam follower fixed to at least one of the jaws and an adjustable cam having a cam surface with a series of steps formed therein, each step corresponding to a different partially open position of the jaws, the position of said cam being adjustable to ensure that the cam follower engages a predetermined one of the steps in the open position of the jaws, means being provided for moving the cam to allow the jaws to close about the wire.

16. Apparatus as claimed in claim 15, comprising a second cam upon which the cam follower rests in said fully open position of the jaws, the second cam being movable to allow the cam follower to engage said predetermined step on the adjustable cam, to allow the jaws to move from said fully open position to said partially closed position.

17. Apparatus as claimed in claim 16, wherein each cam is in the form of a cam wheel, the cam wheels being rotatable in juxtaposed parallel relationship in a housing in which the jaws are slideable, the cam follower being urged towards the cams by resilient means.

18. Apparatus as claimed in any one of claims 14, wherein the laser beam generating and sensing means are mounted for adjustment towards and away from the wire gripper unit, upon a yoke which is pivotably attached to a support for the wire gripper unit, an adjustment knob on the support being rotatable to pivot the support towards and away from the wire gripper unit.

* * * * *